United States Patent [19]

Wehner

[11] 4,012,914

[45] Mar. 22, 1977

[54] MINE ROOF SUPPORT

[75] Inventor: Karl Heinz Wehner, Castrop-Rauxel, Germany

[73] Assignee: Klockner-Werke AG, Duisburg, Germany

[22] Filed: Jan. 22, 1976

[21] Appl. No.: 651,469

[30] Foreign Application Priority Data

Apr. 22, 1975 Germany ..... 2517732

[52] U.S. Cl. ..... 61/45 D; 248/357

[51] Int. Cl.[2] ..... E21D 15/44

[58] Field of Search ..... 61/45 D; 299/31, 33; 248/357; 91/170 MP

[56] References Cited

UNITED STATES PATENTS

| | | | |
|---|---|---|---|
| 3,877,234 | 4/1975 | Martinko et al. | 61/45 D |
| 3,921,409 | 11/1975 | Blumenthal | 61/45 D |

FOREIGN PATENTS OR APPLICATIONS

| | | | |
|---|---|---|---|
| 300,624 | 1971 | U.S.S.R. | 61/45 D |

*Primary Examiner*—Dennis L. Taylor
*Attorney, Agent, or Firm*—Michael J. Striker

[57] ABSTRACT

A mine roof support comprises a support member adapted to rest on the floor of a mine gallery, a first shield projecting upwardly from the rear end of the support member, a second shield pivotally attached at its lower end to the upper end of the first shield, an expandable and contractable prop between the support member and the second shield for changing the inclination of the latter and a cap adapted to engage the roof of the mine gallery pivotally attached between its ends to the upper end of the second shield to form between the upper surface of the latter and the bottom face of the cap a wedge-shaped space directed away from the face of the mine gallery. The mine roof support further includes an arrangement for preventing loose rock material from penetrating into this space and comprising a rugged flexible web attached at one end to the upper face of the second shield and extending over a guide roll journalled in bearing on the rear end of the cap along the bottom face toward the front end of the latter, and an arrangement mounted in the region of the front end of the cap and operative for maintaining the web in taut condition.

10 Claims, 1 Drawing Figure

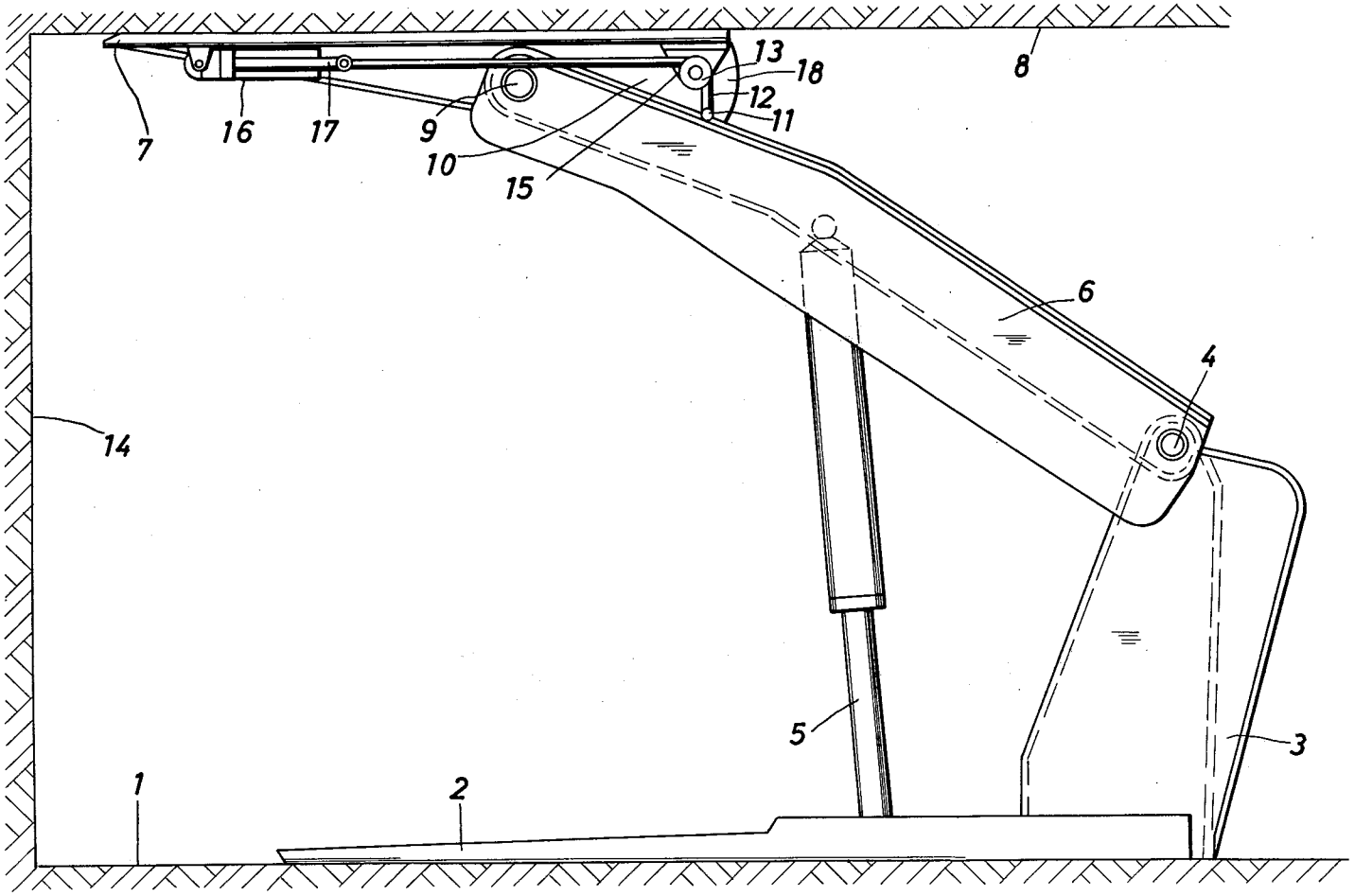
1
2
3
4
5
6
7
8
9
10
11
12
13
14
15
16
17
18

MINE ROOF SUPPORT

BACKGROUND OF THE INVENTION

The present invention relates to a hydraulically operated mine roof support for use in underground excavations and comprising a support member adapted to rest on the floor of the underground excavation or mine gallery, a first shield fixed to and projecting upwardly from the rear end of the support member, a second shield pivotally attached to the upper end of the first shield and inclined with respect to the latter toward the mine face, a cap adapted to engage with its top face the roof of the mine gallery and being pivotally attached intermediate its ends to the upper end of the second shield so as to form a wedge shaped free space between the portion of the bottom face of the cap located rearwardly of the point of its attachment to the second shield and the upper surface of the latter, and an expandable and contractable prop between the support member and the second shield for changing the inclination of the latter and for pressing the top face of the cap against the roof of the mine gallery.

In mine roof supports of the aforementioned kind there is always the danger that the aforementioned wedge-shaped space becomes filled with loose rock material so that, especially when the prop is partially contracted during movement of the roof support from a portion of the mine gallery of greater height to a portion of smaller height, the front end of the cap directed toward the mine face cannot be brought into engagement with the mine roof. In this case a portion of the mine roof above the front end of the cap will not be properly supported so that loose rocks may fall down from the unsupported portion of the mine roof which will lead to a dangerous situation and to undesirable mixing of such rocks with the coal to be mined.

A mine roof support is already known from the German Gebrauchsmuster 7,304,941 in which the cap is constructed in a special manner in an attempt to overcome this problem. In this known construction the cap is provided with side walls which taper toward the front end of the cap and the upper end portion of the second shield, which is reduced in width, is pivotally connected to the cap intermediate the ends of the latter and arranged to be located in certain angular positions of the second shield and the cap with respect to each other at least in part in a cut-out provided in the top wall of the cap. This known construction results in a weakened cap and will not positively prevent loose rocks from penetrating into the mentioned space.

SUMMARY OF THE INVENTION

It is an object of the present invention to provide a mine roof support which overcomes the above mentioned disadvantages of mine roof supports known in the art.

It is a further object of the present invention to provide a mine roof support avoiding the abovementioned disadvantages of mine roof supports known in the art and being constructed of a few and relatively simple parts so that the mine roof support will operate properly during extended use.

With these and other objects in view, which will become apparent as the description proceeds, the mine roof support according to the present invention mainly comprises a support member adapted to rest on the floor of a mine gallery with its front end directed towards the mine face, a first shield fixed to and projecting upwardly from the rear end of the support member, and a second shield pivotally attached to the upper end of the first shield and being inclined with respect to the latter towards the mine face, expandable and contractable prop means pivotally attached at opposite ends to the support member and the second shield between opposite ends of the latter, a cap having a top face adapted to engage the roof of the mine gallery and being pivotally attached intermediate its ends to the upper end of the second shield and having a front end directed toward the mine face and a rear end so as to form a wedge-shaped free space between the portion of the bottom face of the cap located rearwardly of the point of its attachment to the second shield and the upper surface of the latter, and means for preventing entrance of loose rock material into the aforementioned space.

The means for preventing the loose rock material from entering into the aforementioned wedge-shaped space preferably comprise a tear-resistant flexible web connected at one end to the upper surface of the second shield, guide means connected to the cap in the region of the rear end of the latter, over which the web extends along the bottom face of the cap toward the front end of the latter, and means mounted in the region of the front end of said cap and connected to the web for maintaining the same under tension.

The mine roof support according to the present invention will therefore prevent entrance of loose rocks into the aforementioned wedge-shaped space and the construction of the mine roof support is relatively simple and will stand up under the rough operating conditions such a mine roof support is subjected to during its use.

The aforementioned web may be formed from rubber, flexible steel sheet material or a wire netting. The guide means over which the web extends is preferably constituted by a roll mounted in bearings in the region of the rear end of the cap on the bottom face of the latter.

The means for maintaining the web under tension preferably comprise cylinder and piston means mounted in the region of the front end of the cap and having a piston rod connected to the other end of the web, in which the piston of the cylinder and piston means is subjected at the side thereof facing the other end of the web to constant fluid pressure. Instead of a single cylinder and piston means two parallel cylinder and piston means may also be mounted on the front end of the cap and connected to the other end of the web.

The cylinder and piston means provided in the construction according to the present invention will also function, in combination with the web, to press the front end of the cap against the mine roof support.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing schematically illustrates a side view of the mine roof support according to the present invention.

DESCRIPTION OF THE PREFERRED EMBODIMENTS

As shown in the single FIGURE of the drawing, the mine roof support according to the present invention mainly comprises a support member 2 adapted to rest on the floor 1 of a mine gallery or underground excavation with the front end of the support member 2 directed towards the face 14 of the mine gallery. A first shield 3 is fixed to and projects upwardly from the rear end of the support member 2. A second shield 6 is pivotally attached at 4 to the upper end of the first shield 3 and projects from this end forwardly and upwardly inclined toward the roof 8 of the mine gallery. A cap 7 is pivotally attached at 9 intermediate its opposite ends to the upper end of the second shield 6 and engages with its top face the roof 8 of the mine gallery. An expandable and collapsible prop 5 is pivotally attached at opposite ends to the support member 2 and the second shield 6 intermediate the opposite ends of the latter. The prop 5 is of known construction and therefore only schematically illustrated in the drawing, and it is to be understood that the prop may be extended or collapsed by feeding or discharging a liquid under pressure into the same to thereby change the inclination of the second shield 6 and to thereby press the top face of the cap 7 against the roof 8 of the mine gallery. As clearly shown in the drawing a wedge-shaped space 10 it thus formed between the portion of the bottom face of the cap 7 located rearwardly of the pivot pin 9 and the corresponding upper surface of the second shield 6 into which, if no proper provision is made, loose rocks from the roof of the mine gallery may penetrate. Evidently, if the wedge-shaped space 10 is filled more or less with loose rocks, the front end of the cap 7 will not properly engage the roof 8 of the mine gallery if the inclination of the second shield 6 has to be changed to adapt the mine roof support to a mine gallery in which the roof 8 thereof is spaced a smaller distance from the floor 1 than shown in the drawing.

According to the present invention, the mine roof support is provided with means for preventing entrance of loose rock into the wedge-shaped space 10. These means comprise a tear-resistant flexible web 12 connected at one end at 11 in any suitable manner to the upper surface of the second shield 6, guide means, in form of a reversing roll 13, connected to the cap in the region of the rear end of the latter over which the web extends along the bottom face of the cap toward the front end of the latter, and means 16, 17 mounted in the region of the front end of the cap and connected to the web for maintaining the same under tension. The roll 13 is mounted at opposite ends on bearings 15, only the rear one being shown in the drawing, and the bearings 15 are fixed in any convenient manner to the bottom face of the cap 7 in the region of the rear end of the latter.

The means for maintaining the web 12 under tension preferably comprise cylinder and piston means 16 having a piston rod 17 connected to the front edge of the web 12. The annular space in the cylinder 16 about the piston rod 17 is subjected to constant fluid pressure fed thereinto from a source of such fluid pressure, not shown in the drawing. In this way the web 12 is constantly maintained in taut condition, regardless of change of the inclination of the second shield 6.

The web 12 may be formed from rubber, flexible steel sheet, or wire netting.

The cap 7 is further provided with a pair of side walls 18 formed from sheet metal projecting downwardly from longitudinal edges of the cap, of which only the rear side wall is shown in the drawing, and each of the side walls has a substantially triangular configuration increasing in width towards the rear end of the cap to thus also prevent penetration of loose rocks into the space 10, from either side of the cap 7.

It will be understood that each of the elements described above, or two or more together, may also find a useful application in other types of mine roof supports differing from the types described above.

While the invention has been illustrated and described as embodied in a mine roof support, it is not intended to be limited to the details shown, since various modifications and structural changes may be made without departing in any way from the spirit of the present invention.

Without further anaylsis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mine roof support, for use in a mine gallery of underground excavation having a floor, a roof and a mine face, comprising a support member adapted to rest on the floor of a mine gallery and having a front end to be directed towards the mine face and a rear end; a first shield fixed to and projecting upwardly from said rear end of said support member; a second shield having an upper and a lower end and being pivotally connected to said lower end to the upper end of said first shield and extending inclined with respect to the latter towards the mine face, said second shield having an upper surface facing the roof of the mine gallery; expandable and collapsible prop means pivotally attached at opposite ends to said support member and said second shield between opposite ends of the latter; a cap having a top face adapted to engage the roof of the mine gallery and a bottom face, said cap being pivotally attached intermediate its ends to said upper end of said second shield and having a front end directed toward the mine face and a rear end so as to form a wedge-shaped free space between the portion of the bottom face of the cap located rearwardly of the point of its attachment to said second shield and the upper surface of the latter; and means for preventing entrance of loose rock material into said space, including a tear resistant flexible web connected at one end to said upper surface of said second shield, guide means connected to said cap in the region of the rear end of the latter, said web extending over said guide means along the bottom face of the cap toward the front end of the latter, and means for maintaining the web under tension, including at least one cylinder and piston means mounted in the region of said front end of said cap and having a piston rod connected to the other end of said web.

2. A mine roof support as defined in claim 1, wherein said guide means comprises a roll.

3. A mine roof support as defined in claim 1, including bearing means for said roll mounted in the region of said rear end of said cap.

4. A mine roof support as defined in claim 1, wherein the piston of said cylinder and piston means is subjected at the side thereof facing said other end of said web to constant pressure to thus maintain said web in taut condition.

5. A support for use in underground excavations having a floor, a roof and a face comprising, in combination, support means engaging the floor; a cap adapted to engage the roof upwardly of said support means; a shield pivotally connected to said support means and said cap and defining with the latter a wedge-shaped space the volume of which varies in dependence on the pivotal position of said cap relative to said shield; means for angularly displacing said shield relative to said support means to compensate for changes in the distance between the roof and the floor; and means for preventing loose rocks disassociated from the roof from entering said space and thus interfering with the pivoting of said cap relative to said shield, including a tear-resistant flexible web connected to and spanning the distance between said cap and said shield at an open end of said space, and means for tensioning said web so as to prevent deflection of the same into said space under the forces exerted on said web by the loose rocks.

6. A mine roof support as defined in claim 5, wherein said web is formed from rubber.

7. A mine roof support as defined in claim 5, wherein said web is formed from steel sheet.

8. A mine roof support as defined in claim 5, wherein said web is formed from wire netting.

9. A mine roof support as defined in claim 5, wherein said tensioning means comprise at least one cylinder and piston means mounted on said cap and having a piston rod connected to said web.

10. A mine roof support as defined in claim 5, wherein said cap has a pair of side walls projecting downwardly from opposite side edges of the cap.

* * * * *